United States Patent [19]

Blum

[11] Patent Number: 4,609,102

[45] Date of Patent: Sep. 2, 1986

[54] PLASTIC FILM BAG LYOPHILIZATION SYSTEM

[76] Inventor: Alvin S. Blum, 2350 Del Mar Pl., Fort Lauderdale, Fla. 33301

[21] Appl. No.: 687,851

[22] Filed: Dec. 31, 1984

[51] Int. Cl.[4] ..... B65D 81/18

[52] U.S. Cl. ..... 206/216; 206/525; 34/5; 426/106; 426/111; 426/112; 426/385; 426/394; 426/402; 53/432; 53/433

[58] Field of Search ..... 53/428, 432, 433, 111 R, 53/127, 239, 453; 34/5, 201, 202, 92, 237; 206/525, 216; 426/106, 111, 112, 385, 394, 402

[56] References Cited

U.S. PATENT DOCUMENTS

| | | | |
|---|---|---|---|
| 3,715,853 | 2/1973 | Bemiss | 53/433 |
| 3,950,919 | 4/1976 | Perdue | 53/433 |
| 4,058,953 | 11/1977 | Sanborn et al. | 53/433 |
| 4,223,513 | 9/1980 | Mahaffy et al. | 53/432 |
| 4,286,389 | 9/1981 | Ogle | 34/5 |
| 4,342,183 | 8/1982 | Gordon et al. | 53/432 |

*Primary Examiner*—John Sipos
*Assistant Examiner*—Steven P. Weihrouch
*Attorney, Agent, or Firm*—Alvin S. Blum

[57] ABSTRACT

A plastic film bottom tray is held in shape by a rigid bottom rim. A plastic film top is held in shape by a rigid top rim above the tray. Substance to be lyophilized is frozen in the tray. The assembly is lyophilized in a vacuum chamber. Apertures formed between the top and the tray provide fluid pathways for efficient sublimation. After dehydration, the top rim is pushed down into the bottom rim, obliterating the apertures and pressure sealing the two films together in-vacuo.

After removal from the vacuum chamber, the two films are heat sealed together, forming a lyophilized product vacuum sealed within a plastic film bag. Rims and film beyond the heat seal are trimmed away.

17 Claims, 15 Drawing Figures

PLASTIC FILM BAG LYOPHILIZATION SYSTEM

BACKGROUND OF THE INVENTION

This invention relates to methods and apparatus for lyophilizing liquids, solids and suspensions of cells and the like. More specifically, this invention relates to processes and apparatus for lyophilization of the above materials in containers composed of plastic film.

As is well known, lyophilization is a process for dehydrating materials by sublimation from the frozen state in a vacuum. In many applications, and especially when the final product must contain a discrete mass and/or be free of bacterial contamination, the original material is frozen and then dehydrated completely within the container in which it will subsequently be shipped, rehydrated and from which it will be dispensed for use. The container is generally a glass bottle with walls thick enough to withstand a vacuum. The material to be dried is aseptically transferred to the sterile bottle and it is partially closed with a slotted stopper. The material is frozen in the bottle. The water leaves the frozen material (sublimes) as water vapor through the slots in the stopper and collects on a cold condenser in a vacuum chamber. After the water is removed, and while still under vacuum, the stopper is pressed fully into the bottle (up to a flange) occluding the slots and making a vacuum tight seal before the bottle is removed from the vacuum.

However, there are certain drawbacks to the prior art. In order to give the glass bottle sufficient strength to withstand sterilization, vacuum and shipping, its shape must be a tall, narrow cylinder. This shape results in a thick layer of frozen material with a small surface area. These conditions are just the opposite of the conditions necessary for optimum lyophilization, resulting in following deficiencies:

a. Slow heat transfer through the thick bottle walls and thick material layers causing a slow rate of freezing and thereby large crystal formation that ruptures delicate structures, especially in cells.

b. Poor heat transfer through the thick bottle walls and thick material layers, causing partial melting of the frozen material during sublimation when heat must be applied to replace the heat lost in sublimation. This melting of the partially dried solution exposes delicate molecular and cellular structures to extraordinary salt concentrations and surface forces, resulting in denaturation and destruction.

c. Narrow mean free path for water vapor molecules through the thick material layer and narrow stopper slots slows the sublimation rate and contributes to partial melting.

d. The slow rate of movement of reconstituting water through the thick material layer again exposes the material to extraordinary salt concentrations during the rehydration process.

e. The large, heavy, glass containers are bulky to store and costly in energy and money to make, ship, and dispose.

One method used to improve the physical conditions for lyophilization by increasing the surface area and reducing the thickness of the frozen layer is called shell freezing. In this method, the bottle containing the liquid to be lyophilized is tilted and rotated while partially immersed in a freezing bath.

This results in the material being frozen in a thinner layer along the vertical as well as bottom wall. This process is too labor intensive for mass production. Furthermore, it is difficult to heat the sides at the same rate as the bottom in the usual freeze dry chamber with heated shelves.

It should be understood that the rate of freeze drying is related to the rate at which water leaves the frozen material. This in turn is related to the vapor pressure of water in the material. This in turn is related to the temperature of the frozen material. As water sublimes, it absorbs the latent heat of vaporization, cooling the frozen material further and reducing sublimation. Outside heat must be added to replace this loss, but at a controlled rate to prevent uneven temperature distribution, with partial melting. There is negligible convective heat transfer in-vacuo and conductive heat transfer from a warm shelf (the usual production method) is poor through a partially dry, thick layer. Other means of heat input including infra red, microwave and dielectric heating have been employed to overcome the difficulties inherent in conductive heat transfer.

SUMMARY OF THE INVENTION

It is accordingly a primary object of the present invention to provide a lyophilization or freeze drying system that will avoid the above drawbacks. In particular this invention has several objects including:

1. To improve the lyophilization process so that the final reconstituted product is closer in composition to the original material before freeze-drying.

Delicate molecules and cellular elements may be destroyed by:

a. Improper rate of freezing with damaging crystal formation.

b. Partial thawing during the lyophilization process due to inadequate rate of sublimation and/or improper rate of heat input, which subjects constituents to extraordinary salt concentrations and surface forces that may denature proteins and other sensitive molecules and rupture vital cellular elements.

It is an object of the invention to provide a system that will facilitate operation at optimum freezing conditions by providing a large volume chamber with a large bottom surface area for the freezing process without requiring the shipping of a large container.

It is another object of the invention to provide a system with a greatly improved sublimation rate, not only to speed the drying process, but to ensure sufficient thermal loss to avoid melting.

It is another object of the invention to provide a large flat surface area and shallow depth for efficient heat input during lyophilization, with the option of dielectric heating.

2. To provide a more convenient and economical container for freeze/dried materials than the conventional glass bottle with walls thick enough to withstand a vacuum, with a slotted stopper.

3. It is a further object of the invention to provide a container composed of unbreakable resilient plastic film which, when vacuum sealed, occupies little more volume and weighs little more than its dried contents, yet is just as easy to use as current systems.

STRUCTURE

The container system includes a bottom film in a dish shape for holding the material to be lyophilized, and a top covering film which will be heat sealed at its periphery to the bottom film after the water and air are removed.

The top film is held flat be a rigid rim at its periphery. The rim has a solid upper portion holding the film at the film edge and a series of spaced projections extending downwardly, giving somewhat the appearance of a castellated nut.

The bottom film is held peripherally by a rigid bottom rim that also supports the film's dish shape. The dish shape of the bottom film is formed (thermoformed or molded) by turning its edge up and then down. The film therefore has a flat bottom and a double edge extending upward to whatever height is necessary to contain the material to be dried. The doubled edge is held in place by a ridge of the rigid rim. The rigid bottom rim has another upwardly extending ridge distal to the film. When the top is pushed onto the bottom part way, the downward projections of the upper rim engage the upwardly extending, outer ridge of the lower rim and the two are held firmly in place together beyond the films.

OPERATION: FILLING AND FREEZING

For filling, the container appears to be a large shallow dish with a top sealed in place. It may be round or preferably, rectangular. A pierceable diaphragm for reconstituting water and dispensing product is sealed into the top film. The assembly is sterile. It may be easily transported. When ready to fill, a sealing band encircling the side of the container is stripped off, revealing a row of apertures completely encircling the edge, formed by the spaces between the downward projections.

The solution/suspension to be lyophilized is injected through one or more of the apertures. The filled container has a shallow layer of liquid of large area resting on a thin plastic film bottom. This configuration provides efficient heat transfer for rapid freezing in place on a cold surface. The end result is a large area shallow layer of frozen material against an outer wall as in shell freezing, but without the costs or complexities of shell freezing. The filled containers may be frozen on a cold shelf.

Successful freeze-drying of delicate materials such as enzymes and animal cells (blood cells, bull semen, microorganisms) is enhanced by rapid freezing of spherules by injecting a stream of near freezing liquid into a moving volume of extremely cold Freon (TM). Freon is a trademark of the Dupont Co. This may be done through multiple apertures within the large volume of the container. The Freon may then be distilled off below the freezing point of the frozen spherules, which remain behind. These spherules are not only frozen under optimum conditions, but also present increased surface for sublimation and improved conditions for rehydration.

OPERATION: DRYING

When the frozen containers are evacuated in a conventional shelf-type freeze-drying chamber, the circumferential row of apertures provides an enormous cross sectional area pathway for the movement of water vapor, and the very large surface area and shallow depth of frozen material greatly enhance the sublimation rate and heat transfer. Compare this to the small area deep layer of the glass bottle and the narrow pathway of water vapor through the stopper slots of the current system.

OPERATION: SEALING

When lyophilization is completed, the conventional diaphragm stoppering mechanism is activated in the chamber, forcing the top of each container downward. The apertures formed between the upper and lower rims are closed off as one rim is pressed inside the other. The relative movement forces the two films together, forming a pair of pressure seals entirely around the periphery. When the vacuum is released, air pressure forces the top and bottom films together around the dry product, obliterating the empty volume. Each container then passes through a heat seal/trim station. A hot ring element is applied on the innermost pressure seal between the films. This fuses the films together permanently. A trimming blade separates the sealed film bag from the two outer rigid rims with their remnants of film. Alternatively, the trimming operation may be done by pulling the rims free at the outer edge of the heat-softened seal, while the seal is held clamped by the hot ring sealing element.

OPERATION: THE PRODUCT

The final vacuum sealed product is a lyophilized solid sandwiched between closely fitting top and bottom films heat sealed at the perimeter and having fittings sealed into the top film for reconstituting and dispensing. A loop for hanging during dispensing is preferably affixed to the bottom film at some time after the lyophilization step so that the bottom film makes a best fit on the shelf for efficient heat transfer.

The outer rims may be disposable or reusable. Reusable rims grip the film by separate parts that snap together. Disposable rims may work the same way, or may be fused or cemented to the film. The film may be of a coextruded material to combine optimum surface properties for contact with the contents with the most desirable barrier film properties for the outer layer. Steam sterilizable materials (e.g. polypropylene) may be employed.

DIELECTRIC OPTION

A metallization layer may be applied to the outer surface of both films. This may be used during the drying process for dielectric heating, using the upper and lower metal layers as electrodes. Dielectric heating has certain advantages for controlled heat input.

For non-destructive testing and quality control of the finished product, the dielectric properties may be measured using the metal films as electrodes. Any remaining water will markedly alter the dielectric properties, permitting the rejection of bad individual specimens or better control of the drying process.

FREEZE-DRYING SOLIDS

This system is useful especially when discrete volumes of sterile solutions/suspensions are required. It may also be used for the freeze-drying of solids such as foodstuffs or tissues. In this application, of course, the apertures are not used for filling but only for the freeze-drying step. The original material is put in the bottom container, and then the top is fitted in place, forming the apertures. Operation is then as described previously.

STERILITY CONSIDERATIONS

The sterile container may be filled by techniques that keep the sealing band intact. These include:

a. Injection through the top diaphragm.

b. Injection through a separate top fitting that may be sealed after use.

c. Injection through an aperture by sterile puncture of the sealing band.

Further sterility protection may be provided by an optional overhanging projection of the rim of the top cover to reduce bacterial entry through the apertures. Alternatively, a separate top cover with a downwardly extending rim much like the top of a Petri dish may be used to cover the apertures for sterility protection.

DESCRIPTION OF PREFERRED EMBODIMENT

Figure 1:
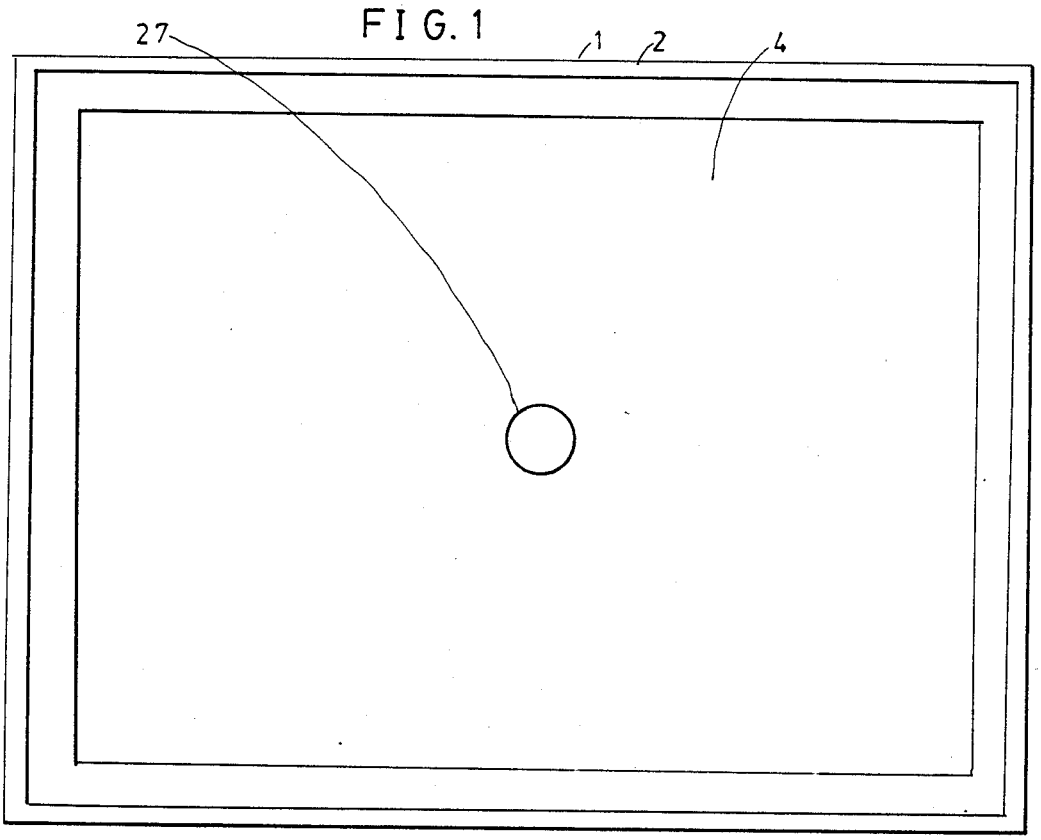
FIG. 1 is a plan view of the container of the invention.
Figure 2:
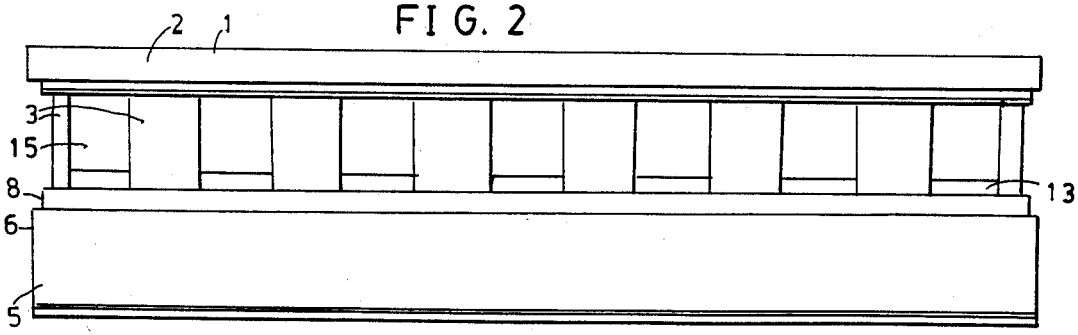
FIG. 2 is a front elevation of the container of FIG. 1.
Figure 3:
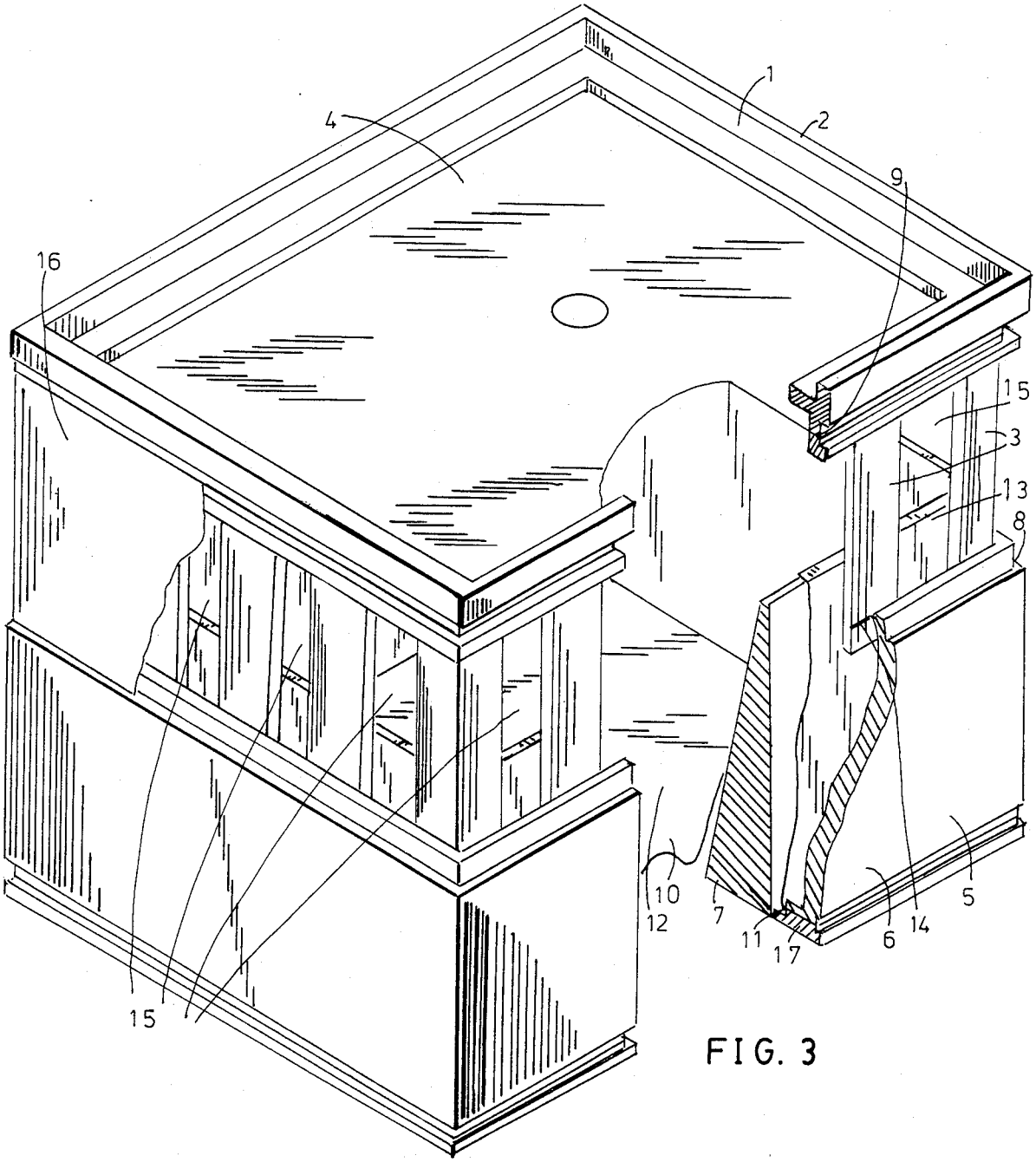
FIG. 3 is a perspective view of the container of FIG. 1 with a portion broken away.

Referring now to FIGS. 1,2 and 3 there is illustrated therein a container of the invention including a top 1 with a rigid rim 2 having downward projections 3 and a plastic film cover 4 attached at its outer edge 9 to the rim 2. A pierceable diaphragm 27 sealed into film 4 provides access to the contents for rehydration and dispensing. The top 1 is partially inserted into the base 5. The base 5 is composed of a three part rigid rim 6 including an inner ridge 7, an outer ridge 8, and a bottom piece 17. A plastic bottom film 10 is attached at its outer edge 11 to the rim 6. The bottom film 10 has the shape of a dish or tray with a large flat bottom portion 12 and a raised, doubled edge 13. The shape of the doubled edge 13 is maintained in the flexible film by the rigid inner ridge 7 of rigid base rim 6. The downward projections 3 of the top 1 engage the inner surface of the outer ridge 8 of base rim 6. Slight ridges 14 on projections 3 act as a stop or detent, holding the top 1 up on the base 5, and leaving apertures 15 between the top and bottom films for the passage of water vapor.

A sealing tape 16, shown partially broken away in FIG. 3, covers the apertures and also further restricts the downward motion of the top 1 into the base 5. This tape would generally be in place during sterilization and transport of the container prior to freeze drying. It is stripped away for the lyophilization process as shown in FIG. 2. In the perspective view of FIG. 3, portions have been broken away to illustrate more clearly the inner ridge 7 supporting the doubled edge 13 of of the bottom film 10.

Figure 4:
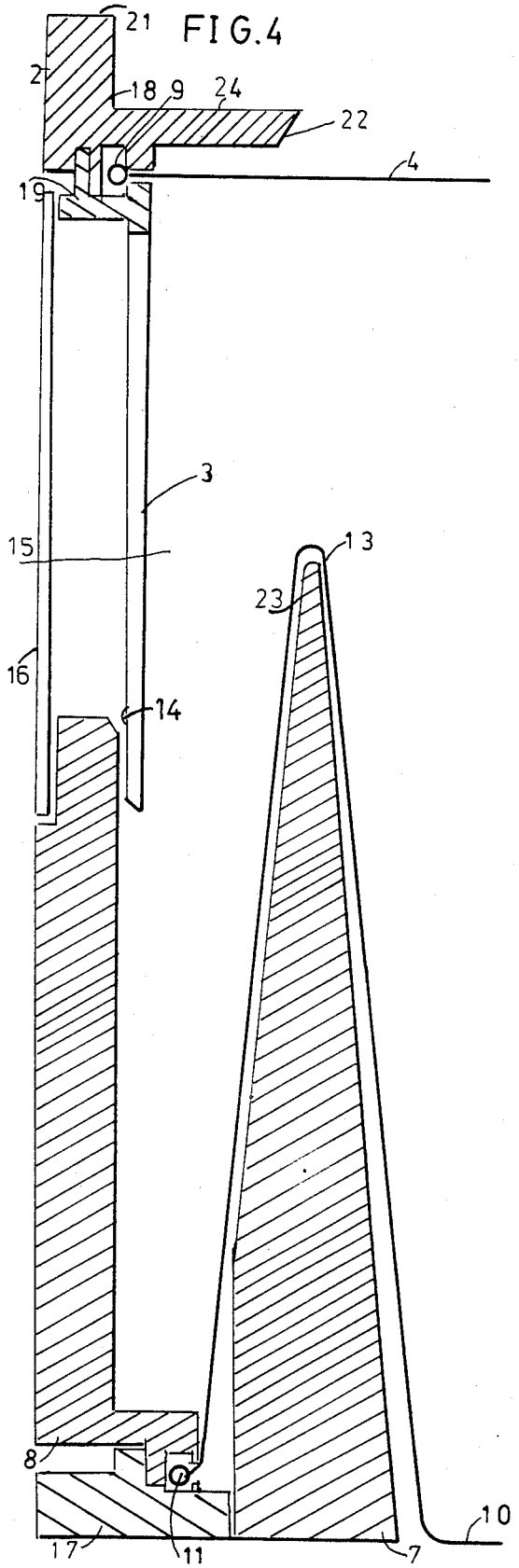
FIG. 4 is a transverse sectional view of a portion of the container of the invention.

FIG. 4 is a partial sectional view of the container of FIG. 3, illustrating in more detail the structural relationships. The rigid base rim is in three parts 7,8 and 17 which snap together. Outer ridge 8 and base piece 17 snap together to clamp the outer edge 11 of the bottom film 10. This edge may be thickened or beaded as shown by the application of local heat to enhance the clamping action. Inner ridge 7 is snapped into place against bottom piece 17 to hold the shape of edge 13 of the bottom film so that it will hold liquid.

The outer ridge 8 engages the projections 3 of the top rim 2 up to detent 14, thereby forming apertures 15 between projections. The sealing tape 16 occludes the apertures.

Rigid top rim 2 is comprised of two pieces, an upper portion 18 and a lower portion 19 which snap together to clamp the edge 9 of the cover film 4.

Figure 5:
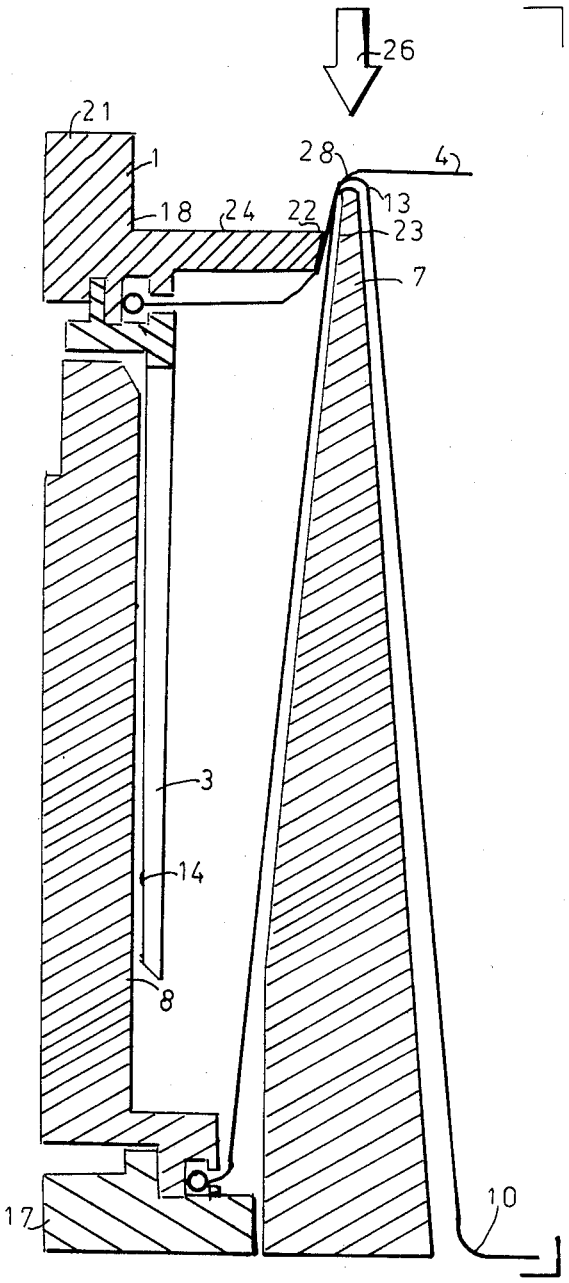
FIG. 5 is a transverse sectional view of a portion of the container of the invention after the top has been pushed down under vacuum.

FIG. 5 is a view similar to FIG. 4, showing the same structures after the sealing tape is removed, the solution 20 lyophilized, and the top 1 pushed down beyond the detent 14, while still in the vacuum chamber. This results from the stopper sealing mechanism within the chamber applying a downward force to the highest point 21 of the top rim 2.

The downward motion of the top is arrested by the pressure of the inner edge 22 of the upper portion 18 of the top rim against the sloping outer surface 23 of the inner ridge 7. This pressure pinches the top and bottom films together at this point, effectively sealing them together in a first seal. The friction of detent 14 against ridge 8 will maintain this pressure after the stoppering force is removed. A certain amount of flexibility in projection 3 and horizontal portion 24 of the upper portion of the top rim enhances this action.

The downward motion of the top has resulted in the inner ridge 7 thrusting the top of edge 13 of the bottom film 10 against the cover film 4 and forcing them upward thereby forming a second seal at the point indicated by the hollow arrow 26. The first seal will be a more positive seal at the time the container is removed from the vacuum chamber. It will ensure that air does not enter the container. The hollow arrow 26 emphasizes the location of the second seal because this is the point 28 at which the two films will be heated to fuse them together after the container is removed from the vacuum chamber. The plastic film beyond the heat seal may be trimmed away with a knife. Alternatively, while the heating element (which may be represented by the hollow arrow 26) is pressing and melting the two films together against the top of ridge 7 at a heat sealing station, an upward force against the bottom piece 17 of the base rim will lift away both rims and the remnants of the film beyond the heat seal, leaving the sealed plastic film bag resting in the inner ridge 7 for later removal.

FIGS. 6 through 13 are diagrammatic illustrations of successive stages in the preparation and use of the invention.

Figure 6:
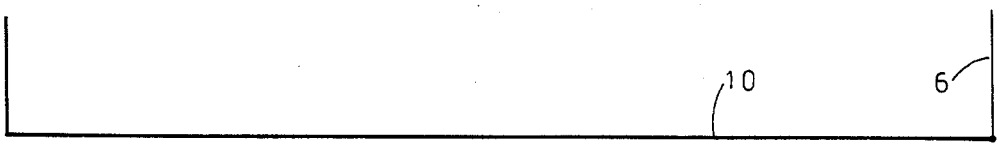

In FIG. 6 a plastic film 10 is fastened to a rigid base rim 6.

Figure 7:
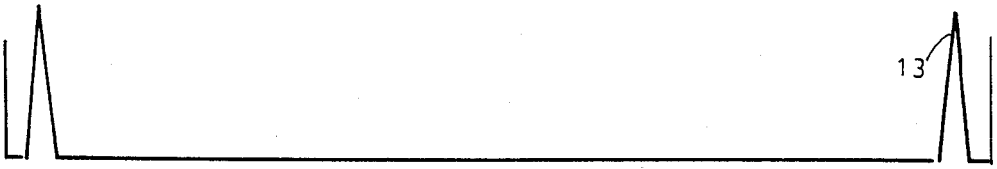

The film is then thermoformed to the shape of FIG. 7 to provide a raised, doubled edge 13.

Figure 8:
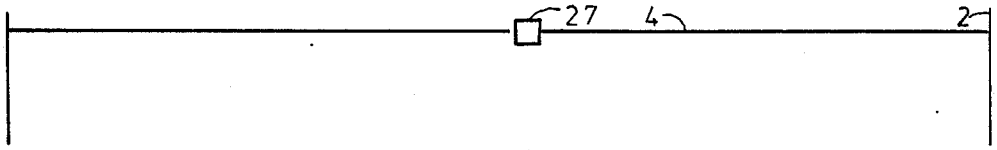

In FIG. 8, plastic cover film 4 is fastened to rigid top rim 2. Film 4 has a rubber diaphragm 27 sealed at its center.

Figure 9:
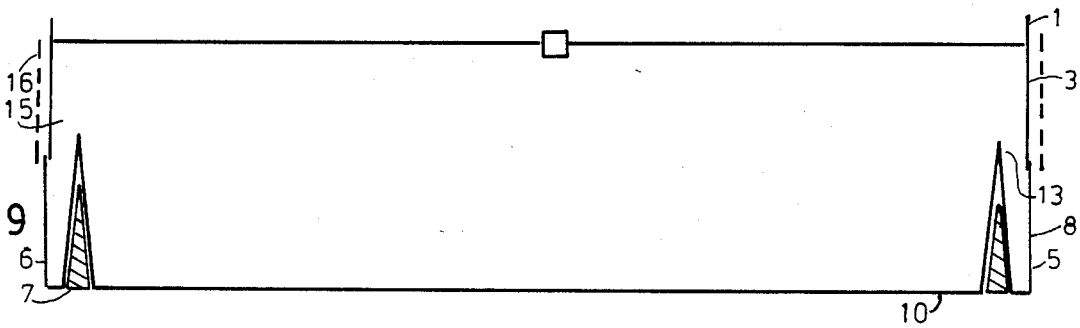

In FIG. 9, inner ridge 7 of base rim 6 supports thermoformed edge 13 of plastic bottom film 10. Top 1 has been forced into base 5 with downward projections 3 of top 1 engaging outer ridge 8 of rigid base rim 6, thereby holding it in place. Sealing tape 16 covers apertures 15.

Figure 10:
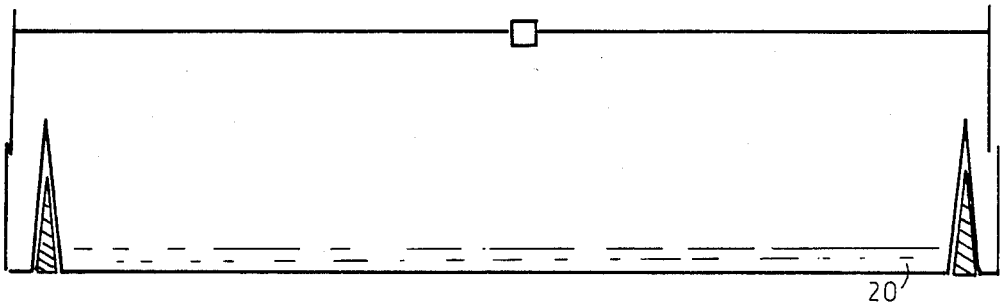

In FIG. 10, the tape is removed, the solution 20 is introduced and dehydrated in the vacuum chamber.

Figure 11:
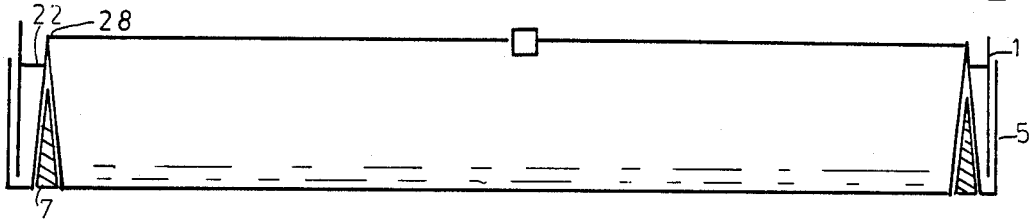

FIG. 11 shows how the contents are sealed while still in the vacuum chamber by simply pushing the top 1 down into the base 5. A first seal is formed by edge 22 pinching both films against ridge 7. A second sealing point 28 is formed by the upward thrust of inner ridge 7.

Figure 12:
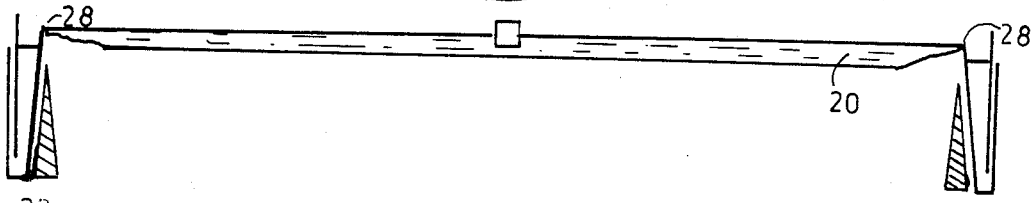

FIG. 12 shows how the plastic film bag, pressure sealed in vacuum at its outer edge, collapses around the dry contents 20 by atmospheric pressure when it is removed from vacuum. In this condition, the two films are heat sealed together at point 28.

Figure 13:
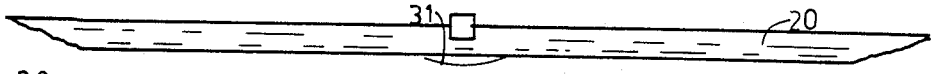
FIGS. 6–13 are a series of diagrammatic transverse sectional views of the container of the invention illustrating progressive stages of its fabrication and operation.

FIG. 13 illustrates the final product, a vacuum sealed plastic bag containing a freeze dried material 20. A hanging loop 31 may be attached to the film base after sealing.

Figure 15:
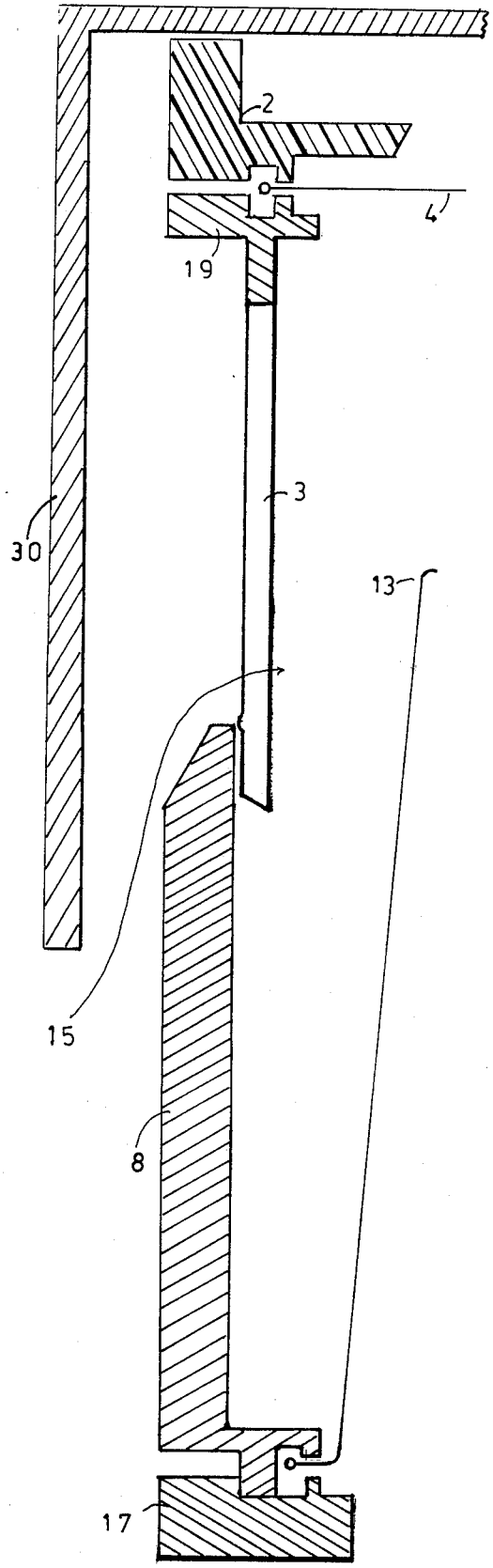
FIG. 15 is a transverse sectional view of a portion of the container of the invention with a Petri-dish-like cover protecting the apertures.
Figure 14:
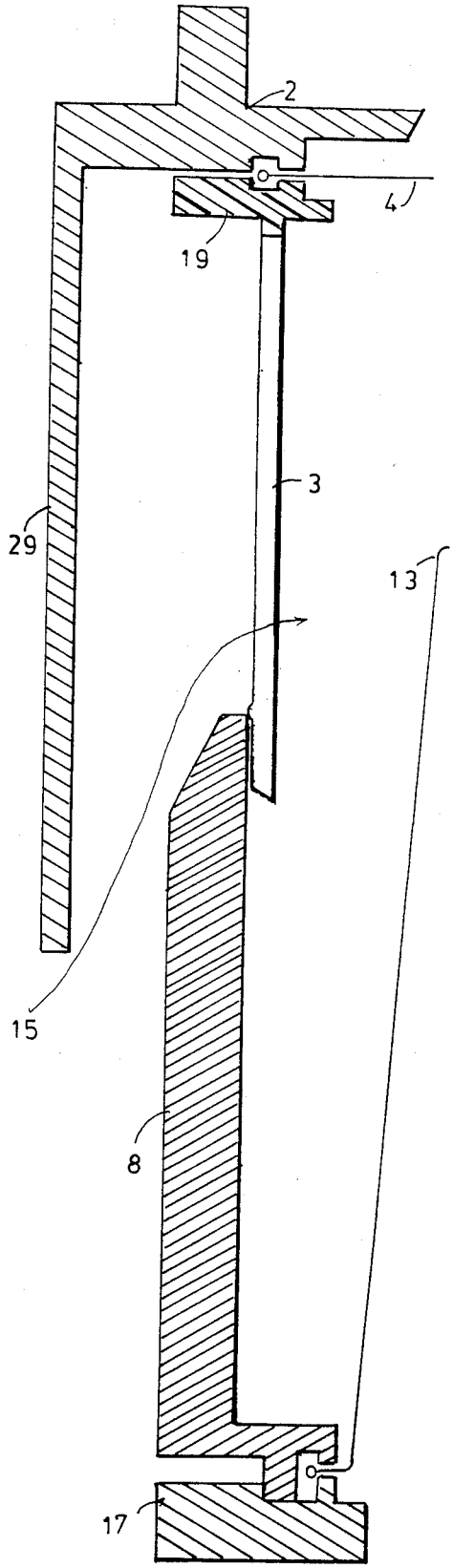
FIG. 14 is a transverse sectional view of a portion of the container of the invention with a projection of the top rim protecting the apertures.

FIG. 14 shows a detail of an alternate configuration of the top rim having a projection 29 covering the apertures 15 to enhance sterility. It is spaced away from the apertures enough to avoid restricting the passage of water vapor. FIG. 15 shows a detail of an alternate embodiment employing a separate, removable extra top cover 30 that acts much like a Petri dish cover in occluding and protecting apertures 15 from bacterial contamination.

The above disclosed invention has a number of particular features which should preferably be employed in combination although each is useful separately without departure from the scope of the invention. Inasmuch as the invention is subject to many variations, modifications, and changes in detail, it is intended that all matter described above be interpreted as illustrative and not in a limiting sense.

What is claimed is:

1. A lyophilization system for filling a container means with a substance to be dehydrated, freeze-drying said substance while within said container means and sealing said container means so as to provide a lyophilized substance within a vacuum-sealed filmy material bag container, comprising:

A. a container means including, a. a filmy material bottom sheet means shaped into a tray means with a generally flat bottom and elevated perimeter for containing said substance to be dehydrated, said flat bottom adapted for efficient heat transfer by direct contact with a heat transfer surface, and b. a filmy material top sheet means of substantially flat shape for providing a cover for said tray means:

B. a base, said base including base rim means connected to said bottom sheet means peripherally for supporting said bottom sheet means peripherally and maintaining its tray shape, said base rim means having a central opening for said flat bottom to permit said flat bottom to make contact with said heat transfer surface without intervening structure;

C. a top, said top including top rim means connected peripherally to said top sheet means for supporting the shape of said cover;

D. holding and spacing means incorporated in said base and said top for holding said top by said top rim means in a fixed, open, first position above said base by said top rim means engaging said base rim means, said open, first position providing a plurality of peripheral spaces between said top sheet means and said bottom sheet means for the passage of fluid therebetween during the lyophilization process, said holding and spacing means further having compressing means for holding said top in a fixed, closed, second position against said base, thereby compressing and hermetically sealing said top sheet means to said elevated perimeter of said bottom sheet means, said holding and spacing means further providing guidance for sliding movement of said top relative to said base from said first position to said second position upon the application of closing forces between said top and said base while within an evacuated chamber after the lyophilization process has been completed; said holding and spacing means adapted for heat sealing said top sheet means to said bottom sheet means at the region where said top sheet and said bottom sheet means are juxtaposed in said second position, said heat sealing being performed after removal of said top and said base, in hermetically sealed second position, from said evacuated chamber.

2. The invention of claim 1, including trimming away means for removal of said top rim means said base rim means and those portions of said filmy material distal to the seal formed by said heat sealing.

3. The invention of claim 1, including at least one resealable closure means sealed into said top sheet means for the addition or withdrawal of fluids from said container means.

4. The invention of claim 3, wherein said resealable closure means includes a pierceable resilient diaphragm means.

5. The invention of claim 3, wherein said resealable closure means includes a screw cap means.

6. The invention of claim 1, wherein said filmy material sheet means is a resilient thermoplastic film.

7. The invention of claim 1, wherein said filmy material sheet means is a resilient coextruded thermoplastic film comprising two materials having properties suited for contact with said substance on a first side and properties suited for the exterior of said bag on a second side.

8. The invention of claim 6, wherein said film is coated on its outer face with a metal layer for heating by dielectric means.

9. The invention of claim 6, wherein said film is coated on its outer face with a metal layer for monitoring water content by dielectric property sensing means.

10. The invention of claim 1, wherein said holding and spacing means comprises spaced-apart downward projections of said top rim means distal to said top sheet means, and said base rim means includes an upwardly extending outer ridge means distal to said bottom sheet means so adapted that said downward projections frictionally engage said outer ridge means for holding said top above said base and said peripheral spaces are the apertures formed between said downward projections.

11. The invention of claim 1, said elevated perimeter of said tray comprising a raised, doubled edge of said bottom sheet means and said base rim means further including an inner ridge means extending upwardly into, and supporting thereby, said doubled edge of said bottom sheet means.

12. The invention of claim 1, wherein said container is sterile, including aperture sealing tape means removably covering said peripheral spaces for maintaining sterility within said container.

13. The invention of claim 1 wherein said container is sterile, including aperture covering means extending downwardly from said top rim means and covering said peripheral spaces from above sufficiently to maintain sterility while leaving sufficient passage for water vapor during lyophilization.

14. The invention of claim 1, wherein said top rim means comprises at least two separate rims which snap together to clamp the edge of said top sheet means.

15. The invention of claim 1, wherein said bottom rim means comprises at least two separate rims which snap together to clamp the edge of said bottom sheet means.

16. The invention of claim 1, wherein said heat sealing is secondly applied to a region of juxaposition of said top sheet means and said bottom sheet means that is fully enclosed by the region of said top sheet means and said bottom sheet means compressed and hermetically sealed together firstly while within said evacuated chamber to ensure that the contents of said container means does not include ambient air entrapped between the two said regions that might enter the container after said top rim means and said bottom rim means are removed and compressive forces thereby released.

17. The invention of claim 1, including heat sealing means for heat sealing said top sheet means to said bottom sheet means after said top and said base, in hermetically-sealed second position, is removed from said evacuated chamber.

* * * * *